US009020709B2

(12) United States Patent
Matsuyama

(10) Patent No.: US 9,020,709 B2
(45) Date of Patent: Apr. 28, 2015

(54) EXCAVATION CONTROL SYSTEM

(75) Inventor: Toru Matsuyama, Kanagawa (JP)

(73) Assignee: Komatsu Ltd., Tokyo (JP)

( * ) Notice: Subject to any disclaimer, the term of this patent is extended or adjusted under 35 U.S.C. 154(b) by 33 days.

(21) Appl. No.: 13/983,116

(22) PCT Filed: Feb. 7, 2012

(86) PCT No.: PCT/JP2012/052687

§ 371 (c)(1),
(2), (4) Date: Aug. 1, 2013

(87) PCT Pub. No.: WO2012/127914

PCT Pub. Date: Sep. 27, 2012

(65) Prior Publication Data

US 2013/0315699 A1 Nov. 28, 2013

(30) Foreign Application Priority Data

Mar. 24, 2011 (JP) ..... 2011-066826

(51) Int. Cl.
*G06F 7/00* (2006.01)
*G06F 17/00* (2006.01)
(Continued)

(52) U.S. Cl.
CPC . *E02F 3/435* (2013.01); *E02F 3/30* (2013.01); *E02F 3/437* (2013.01); *E02F 9/2203* (2013.01); *E02F 9/262* (2013.01); *E02F 9/265* (2013.01)

(58) Field of Classification Search
USPC ..... 701/50–51; 414/685, 687; 37/234, 348; 172/2
See application file for complete search history.

(56) References Cited

U.S. PATENT DOCUMENTS 5,174,114 A * 12/1992 Aoyagi ..... 91/446
5,701,691 A * 12/1997 Watanabe et al. ..... 37/348
(Continued)

FOREIGN PATENT DOCUMENTS

JP 95/30059 A1 11/1995
JP 8-134949 A 5/1996
(Continued)

OTHER PUBLICATIONS

Chondrobot-2: A simple and efficient semi-autonomous tele-robotic lunar excavator ; Rhaman, M.K. ; Hossain, M.J. ; Anik, K.M.R. ; Oyon, M.H. ; Nabia, S.B.N. ; Rahi, N.S. ; Khan, B.A. ; Miran, M.M.R. ; Bhuian, B.H. ; Rahman, M.M;Computer and Information Technology (ICCIT), 2012 15th International Conference on; DOI: 10.1109/ICCITechn.2012.6509787.*
(Continued)

*Primary Examiner* — Cuong H Nguyen
(74) *Attorney, Agent, or Firm* — Global IP Counselors, LLP

(57) ABSTRACT

An excavation control system includes a working unit, hydraulic cylinders, a prospective speed obtaining part, a relative speed obtaining part, a speed limit selecting part and a hydraulic cylinder controlling part. The prospective speed obtaining part obtains first and second prospective speeds depending on first and second intervals between first and second monitoring points of the bucket and a designed surface, respectively. The relative speed obtaining part obtains first and second relative speeds of the first and second monitoring points relative to the designed surface, respectively. The speed limit selecting part selects one of the first and second prospective speeds as a speed limit based on relative relations between the first and second relative speeds and the first and second prospective speeds, respectively. The hydraulic cylinder controlling part limits a relative speed of one of the first and second monitoring points to the speed limit.

10 Claims, 10 Drawing Sheets

(51) Int. Cl.

| | |
|---|---|
| ***G06F 19/00*** | (2011.01) |
| ***E02F 3/30*** | (2006.01) |
| ***E02F 3/43*** | (2006.01) |
| ***E02F 9/22*** | (2006.01) |
| ***E02F 9/26*** | (2006.01) |

(56) References Cited

U.S. PATENT DOCUMENTS

| | | | | |
|---|---|---|---|---|
| 5,735,065 | A * | 4/1998 | Yamagata et al. | 37/348 |
| 5,835,874 | A * | 11/1998 | Hirata et al. | 701/50 |
| 5,911,506 | A * | 6/1999 | Nakamura et al. | 37/348 |
| 5,957,989 | A * | 9/1999 | Egawa et al. | 701/50 |
| 5,960,378 | A * | 9/1999 | Watanabe et al. | 702/150 |
| 6,275,757 | B1 * | 8/2001 | Watanabe et al. | 701/50 |
| 6,336,067 | B1 * | 1/2002 | Watanabe et al. | 701/50 |
| 7,370,475 | B2 * | 5/2008 | Nakamura et al. | 60/449 |
| 8,214,110 | B2 * | 7/2012 | Morinaga et al. | 701/50 |
| 8,534,264 | B2 * | 9/2013 | Kawaguchi et al. | 123/350 |
| 2012/0285157 | A1 * | 11/2012 | Okano et al. | 60/445 |

FOREIGN PATENT DOCUMENTS

| | | | |
|---|---|---|---|
| JP | 2009-179968 | A | 8/2009 |
| JP | 4493990 | B2 * | 6/2010 |
| JP | 5156312 | B2 * | 3/2013 |
| KR | 1391104 | B1 * | 4/2014 |
| WO | WO 2005052372 | A1 * | 6/2005 |
| WO | WO 2009038016 | A1 * | 3/2009 |

OTHER PUBLICATIONS

An experimental study on Cartesian tracking control of automated excavator system using TDC-based robust control design Soo-Jin Lee ; Pyung Hun Chang ; Young-Min Kwon; American Control Conference, 1999. Proceedings of the 1999 vol. 5; DOI: 10.1109/ACC.1999.782351; Publication Year: 1999 , pp. 3180-3185 vol. 5.*

Soil cutting experiments and evaluation of an earth auger for a planetary subsurface explorer; Omori, H. ; Kitamoto, H. ; Mizushina, A. ; Nakamura, T. ; Osumi, H. ; Kubota, T.; Recent Advances in Space Technologies (RAST), 2013 6th International Conference on DOI: 10.1109/RAST.2013.6581350; Publication Year: 2013 , pp. 941-947.*

Hybrid model in a real-time soil parameter identification scheme for autonomous excavation; Choopar Tan ; Zweiri, Y.H. ; Althoefer, K. ; Seneviratne, L.D.; Robotics and Automation, 2004. Proceedings. ICRA '04. 2004 IEEE International Conference on; vol. 5 DOI: 10.1109/ROBOT.2004.1302554; Publication Year: 2004 , pp. 5268-5273.*

International Search Report for PCT/JP2012/052687, issued on May 15, 2012.

* cited by examiner

EXCAVATION CONTROL SYSTEM

CROSS-REFERENCE TO RELATED APPLICATIONS

This application claims priority to Japanese Patent Application No. 2011-066826, filed on Mar. 24, 2011, the disclosure of which is hereby incorporated herein by reference in its entirety.

BACKGROUND

1. Field of Invention

The present invention relates to an excavation control system configured to impose a limitation on the speed of a working unit.

2. Background Information

For a construction machine equipped with a working unit, a method has been conventionally known that a predetermined region is excavated by moving a bucket along a designed surface indicating a target shape for an excavation object (see PCT International Publication No. WO95/30059).

Specifically, a control device in PCT International Publication No. WO95/30059 is configured to correct an operation signal to be inputted by an operator so that the relative speed of the working unit relative to the designed surface is reduced as an interval is reduced between the cutting edge of the bucket and the designed surface. Thus, an excavation control of automatically moving the cutting edge along the designed surface is executed regardless of an operation by an operator.

SUMMARY

However, the excavation control described in PCT International Publication No. WO95/30059 has chances that the surface of an excavation object is excessively excavated by the rear surface of the bucket in scooping. Further, the excavation control described in PCT International Publication No. WO95/30059 has chances that the rear surface of the bucket cannot be controlled on the designed surface in ground level finishing.

The present invention has been produced in view of the aforementioned situation, and is intended to provide an excavation control system capable of appropriately executing an excavation control.

An excavation control system according to a first aspect includes a working unit, a plurality of hydraulic cylinders, a prospective speed obtaining part, a relative speed obtaining part, a speed limit selecting part and a hydraulic cylinder controlling part. The working unit is formed by a plurality of driven members including a bucket, and is rotatably supported by a vehicle main body. The plural hydraulic cylinders are configured to drive the plurality of driven members. The prospective speed obtaining part is configured to obtain a first prospective speed and a second prospective speed, the first prospective speed depends on a first interval between a first monitoring point of the bucket and a designed surface, the second prospective speed depends on a second interval between a second monitoring point of the bucket and the designed surface, the second monitoring point set be differently from the first monitoring point, and the designed surface indicates a target shape of an excavation object The relative speed obtaining part is configured to obtain a first relative speed of the first monitoring point relative to the designed surface and a second relative speed of the second monitoring point relative to the designed surface. The speed limit selecting part is configured to select either of the first prospective speed and the second prospective speed as a speed limit based on a relative relation between the first relative speed and the first prospective speed and a relative relation between the second relative speed and the second prospective speed. The hydraulic cylinder controlling part is configured to limit a relative speed of either one of the first and second monitoring points which is a target of the speed limit to the speed limit by supplying an operating oil to the plurality of hydraulic cylinders, and the relative speed is relevant to the designed surface.

An excavation control system according to a second aspect related to the excavation control system according to the first aspect, and further includes a regulated speed obtaining part. The regulated speed obtaining part is configured to obtain a first regulated speed and a second regulated speed, the first regulated speed indicates a target speed for an extension/contraction speed of each of the plurality of hydraulic cylinders which is required to limit the first relative speed to the first prospective speed, and the second regulated speed indicates a target speed for an extension/contraction speed of each of the plurality of hydraulic cylinders which is required to limit the second relative speed to the second prospective speed. The speed limit selecting part is configured to select the first prospective speed as the speed limit when the first regulated speed is greater than the second regulated speed, and select the second prospective speed as the speed limit when the second regulated speed is greater than the first regulated speed.

It is possible to provide an excavation control system capable of smoothly executing an excavation control.

DESCRIPTION OF EMBODIMENTS

Explanation will be hereinafter made for an exemplary embodiment of the present invention with reference to the drawings. In the following explanation, a hydraulic excavator will be explained as an example of "construction machine".

Overall Structure of Hydraulic Excavator 100

Figure 1:
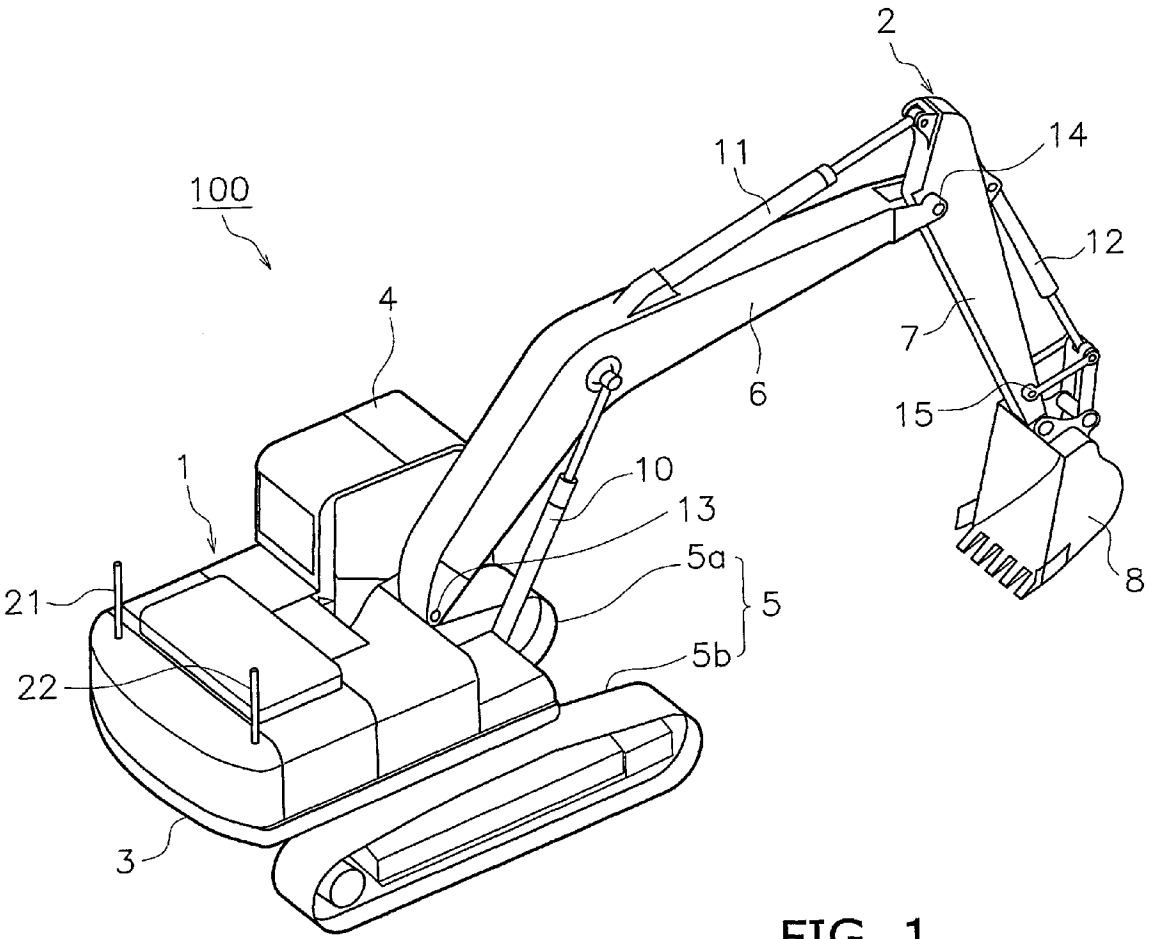
FIG. 1 is a perspective view of a hydraulic excavator 100.

FIG. 1 is a perspective view of a hydraulic excavator 100 according to an exemplary embodiment. The hydraulic excavator 100 includes a vehicle main body 1 and a working unit 2. Further, the hydraulic excavator 100 is embedded with an excavation control system 200. Explanation will be made below for a configuration and an action of the excavation control system 200.

The vehicle main body 1 includes an upper revolving unit 3, a cab 4 and a drive unit 5. The upper revolving unit 3 accommodates an engine, a hydraulic pump and so forth (not illustrated in the figures). A first GNSS antenna 21 and a second GNSS antenna 22 are disposed on the rear end part of the upper revolving unit 3. The first GNSS antenna 21 and the second GNSS antenna 22 are antennas for RTK-GNSS (Real Time Kinematic—GNSS, note GNSS refers to Global Navigation Satellite Systems). The cab 4 is mounted on the front part of the upper revolving unit 3. An operating device 25 to be described is disposed within the cab 4 (see FIG. 3). The drive unit 5 includes crawler belts 5*a* and 5*b*, and circulation of the crawler belts 5*a* and 5*b* enables the hydraulic excavator 100 to travel.

The working unit 2 is attached to the front part of the vehicle main body 1, and includes a boom 6, an arm 7, a bucket 8, a boom cylinder 10, an arm cylinder 11 and a bucket cylinder 12. The base end of the boom 6 is pivotally attached to the front part of the vehicle main body 1 through a boom pin 13. The base end of the arm 7 is pivotally attached to the tip end of the boom 6 through an arm pin 14. The bucket 8 is pivotally attached to the tip end of the arm 7 through a bucket pin 15.

The boom cylinder 10, the arm cylinder 11 and the bucket cylinder 12 are respectively hydraulic cylinders to be driven by means of an operating oil. The boom cylinder 10 is configured to drive the boom 6. The arm cylinder 11 is configured to drive the arm 7. The bucket cylinder 12 is configured to drive the bucket 8.

Figure 2A:
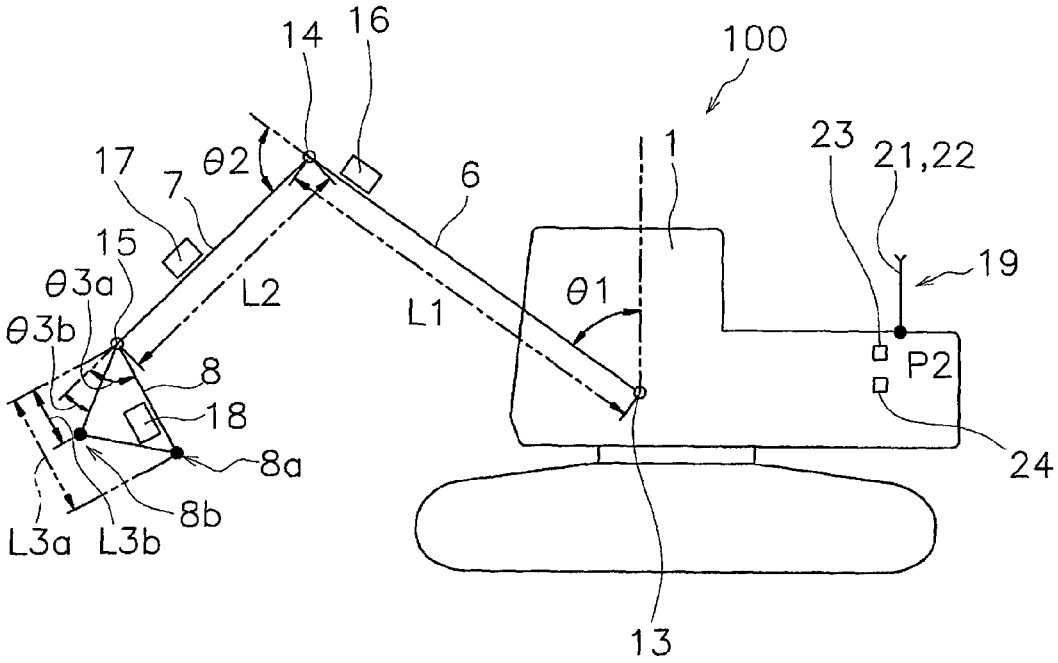
FIG. 2A is a side view of the hydraulic excavator 100.
Figure 2B:
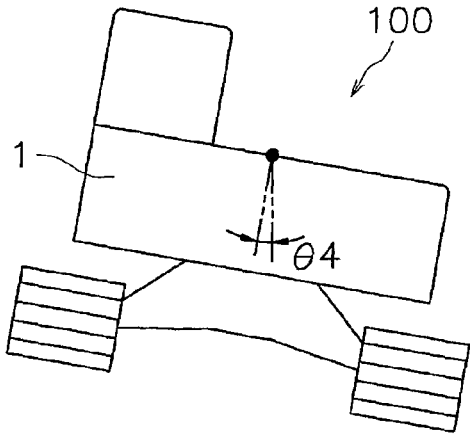
FIG. 2B is a rear view of the hydraulic excavator 100.

Now, FIG. 2A is a side view of the hydraulic excavator 100, whereas FIG. 2B is a rear view of the hydraulic excavator 100. As illustrated in FIG. 2A, the length of the boom 6, i.e., the length from the boom pin 13 to the arm pin 14 is L1. The length of the arm 7, i.e., the length from the arm pin 14 to the bucket pin 15 is L2. The length of the bucket 8, i.e., the length from the bucket pin 15 to the tip ends of teeth of the bucket 8 (hereinafter referred to as "a cutting edge 8*a*" as an example of "a first monitoring point") is L3*a*. Further, the length from the bucket pin 15 to the rear surface side outermost end of the bucket 8 (hereinafter referred to as "a rear surface end 8*b*" as an example of "a second monitoring point") is L3*b*.

Further, as illustrated in FIG. 2A, the boom 6, the arm 7 and the bucket 8 are provided with first to third stroke sensors 16 to 18 on a one-to-one basis: The first stroke sensor 16 is configured to detect the stroke length of the boom cylinder 10 (hereinafter referred to as "a boom cylinder length N1"). Based on the boom cylinder length N1 detected by the first stroke sensor 16, a display controller 28 to be described (see FIG. 3) is configured to calculate a slant angle θ1 of the boom 6 relative to the vertical direction in the Cartesian coordinate system of the vehicle main body. The second stroke sensor 17 is configured to detect the stroke length of the arm cylinder 11 (hereinafter referred to as "an arm cylinder length N2"). Based on the arm cylinder length N2 detected by the second stroke sensor 17, the display controller 28 is configured to calculate a slant angle θ2 of the arm 7 with respect to the boom 6. The third stroke sensor 18 is configured to detect the stroke length of the bucket cylinder 12 (hereinafter referred to as "a bucket cylinder length N3"). Based on the bucket cylinder length N3 detected by the third stroke sensor 18, the display controller 28 is configured to calculate a slant angle θ3*a* of the cutting edge 8*a* with respect to the arm 7 and a slant angle θ3*b* of the rear surface end 8*b* with respect to the arm 7.

The vehicle main body 1 is equipped with a position detecting unit 19. The position detecting unit 19 is configured to detect the present position of the hydraulic excavator 100. The position detecting unit 19 includes the aforementioned first and second GNSS antennas 21 and 22, a three-dimensional position sensor 23 and a slant angle sensor 24. The first and second GNSS antennas 21 and 22 are disposed while being separated at a predetermined distance in the vehicle width direction. Signals in accordance with GNSS radio waves received by the first and second GNSS antennas 21 and 22 are configured to be inputted into the three-dimensional position sensor 23. The three-dimensional position sensor 23 is configured to detect the installation positions of the first and second GNSS antennas 21 and 22. As illustrated in FIG. 2B, the slant angle sensor 24 is configured to detect a slant angle θ4 of the vehicle main body 1 in the vehicle width direction with respect to a gravity direction (a vertical line).

Configuration of Excavation Control System 200

Figure 3:
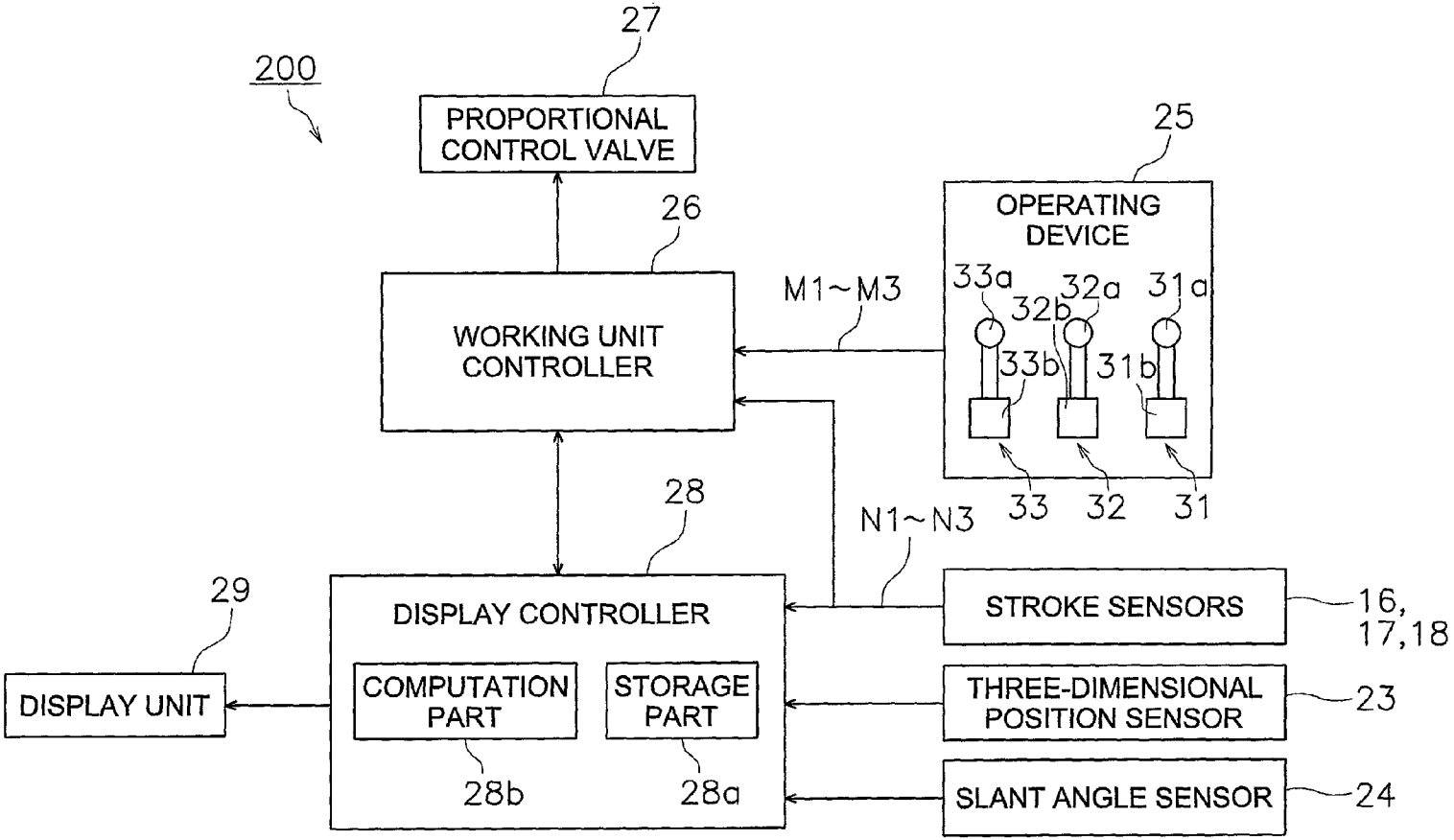
FIG. 3 is a block diagram representing a functional configuration of an excavation control system 200.

FIG. 3 is a block diagram representing a functional configuration of the excavation control system 200. The excavation control system 200 includes the operating device 25, a working unit controller 26, a proportional control valve 27, the display controller 28 and a display unit 29.

The operating device 25 is configured to receive an operation by an operator to drive the working unit 2 and is configured to output an operation signal in accordance with the operation of the operator. Specifically, the operating device 25 includes a boom operating tool 31, an arm operating tool 32 and a bucket operating tool 33. The boom operating tool 31 includes a boom operating lever 31*a* and a boom operation detecting part 31*b*. The boom operating lever 31*a* receives an operation of the boom 6 by the operator. The boom operation detecting part 31*a* is configured to output a boom operation signal M1 in response to an operation of the boom operating lever 31*a*. An arm operating lever 32*a* receives an operation of the arm 7 by the operator. An arm operation detecting part 32*b* is configured to output an arm operation signal M2 in response to an operation of the arm operating lever 32*a*. The bucket operating tool 33 includes a bucket operating lever 33*a* and a bucket operation detecting part 33*b*. The bucket operating lever 33*a* receives an operation of the bucket 8 by the operator. The bucket operation detecting part 33*b* is configured to output a bucket operation signal M3 in response to an operation of the bucket operating lever 33*a*.

The working unit controller 26 is configured to obtain the boom operation signal M1, the arm operation signal M2 and the bucket operation signal M3 from the operating device 25. The working unit controller 26 is configured to obtain the boom cylinder length N1, the arm cylinder length N2 and the bucket cylinder length N3 from the first to third stroke sensors 16 to 18, respectively. The working unit controller 26 is configured to output control signals based on the aforementioned various pieces of information to the proportional control valve 27. Accordingly, the working unit controller 26 is configured to execute an excavation control of automatically moving the bucket 8 along designed surfaces 45 (see FIG. 4). At this time, as described below, the working unit controller 26 is configured to correct the boom operation signal M1 and then output the corrected boom operation signal M1 to the proportional control valve 27. On the other hand, the working unit controller 26 is configured to output the arm operation signal M2 and the bucket operation signal M3 to the proportional control valve 27 without correcting the signals M2 and M3. A function and an action of the working unit controller 26 will be described below.

The proportional control valve 27 is disposed among the boom cylinder 10, the arm cylinder 11, the bucket cylinder 12 and a hydraulic pump (not illustrated in the figures). The proportional control valve 27 is configured to supply the operating oil at a flow rate set in accordance with the control signal from the working unit controller 26 to each of the boom cylinder 10, the arm cylinder 11 and the bucket cylinder 12.

The display controller 28 includes a storage part 28*a* (e.g., a RAM, a ROM, etc.) and a computation part 28*b* (e.g., a CPU, etc.). The storage part 28*a* stores a set of working unit data that contains the aforementioned lengths, i.e., the length L1 of the boom 6, the length L2 of the arm 7 and the lengths L3*a* and L3*b* of the bucket 8. The set of working unit data contains the minimum value and the maximum value for each of the slant angle θ1 of the boom 6, the slant angle θ2 of the arm 7, the slant angle θ3*a* of the cutting edge 8*a* and the slant angle θ3*b* of the rear surface end 8*b*. The display controller 28 can be communicated with the working unit controller 26 by means of wireless or wired communication means. The storage part 28*a* of the display controller 28 has preliminarily stored a set of designed landform data indicating the shape and the position of a three-dimensional designed landform within a work area. The display controller 28 is configured to cause the display unit 29 to display the designed landform based on the designed landform, detection results from the aforementioned various sensors, and so forth.

Figure 4:
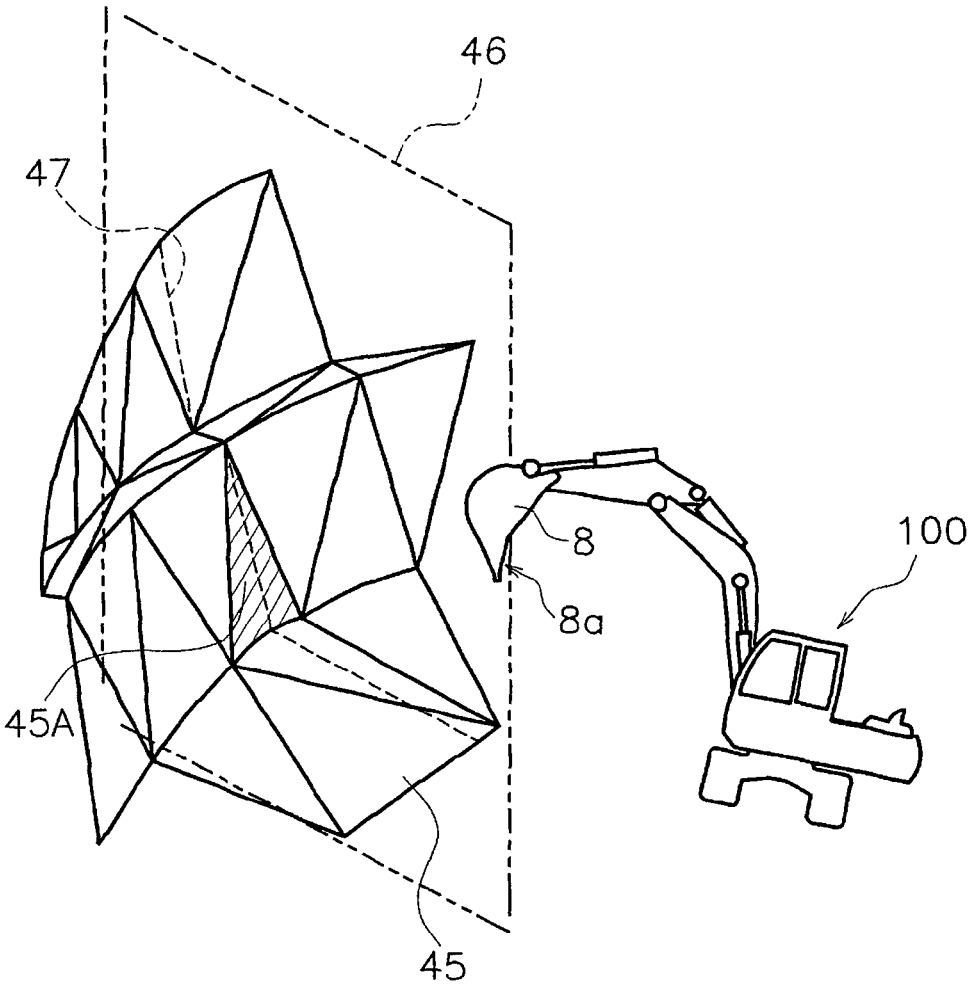
FIG. 4 is a schematic diagram illustrating an exemplary designed landform to be displayed on a display unit 29.

Now, FIG. 4 is a schematic diagram illustrating an exemplary designed landform to be displayed on the display unit 29. As illustrated in FIG. 4, the designed landform is formed by the plurality of designed surfaces 45, each of which is expressed by a triangular polygon. Each of the plurality of designed surfaces 45 indicates the target shape for an object to be excavated by the working unit 2. An operator selects one of the plurality of designed surfaces 45 as a target designed surface 45A. When the operator excavates the target designed surface 45A with the bucket 8, the working unit controller 26 is configured to move the bucket 8 along an intersected line 47 between the target designed surface 45A and a plane 46 passing through the present position of the cutting edge 8*a* of the bucket 8. It should be noted that in FIG. 4, the reference sign 45 is assigned to only one of the plurality of designed surfaces without being assigned to the others of the plurality of designed surfaces.

Figure 5:
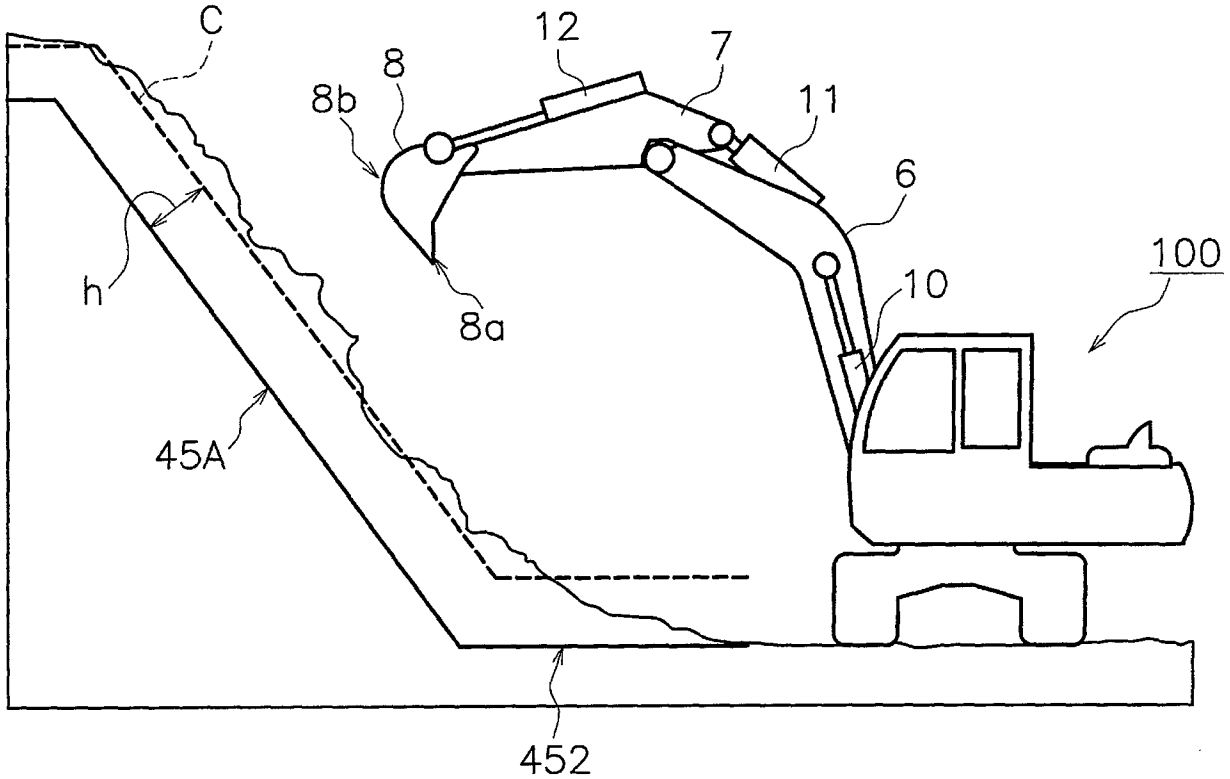
FIG. 5 is a cross-sectional view of the designed landform taken along an intersected line 47.

FIG. 5 is a cross-sectional view of a designed landform taken along the intersected line 47 and is a schematic diagram illustrating an exemplary designed landform to be displayed on the display unit 29. As illustrated in FIG. 5, the designed landform according to the present exemplary embodiment includes the target designed surface 45A and a speed limitation intervening line C.

The target designed surface 45A is a slope positioned laterally to the hydraulic excavator 100. An operator executes excavation along the target designed surface 45A by downwardly moving the bucket 8 from above the target designed surface 45A.

The speed limitation intervening line C defines a region in which speed limitation to be described is executed. As described below, when the bucket 8 enters inside from the speed limitation intervening line C, the excavation control system 200 is configured to execute speed limitation. The speed limitation intervening line C is set to be in a position away from the target designed surface 45A at a line distance h. The line distance h is preferably set to be a distance whereby operational feeding of an operator with respect to the working unit 2 is not deteriorated.

Configuration of Working Unit Controller 26

Figure 6:
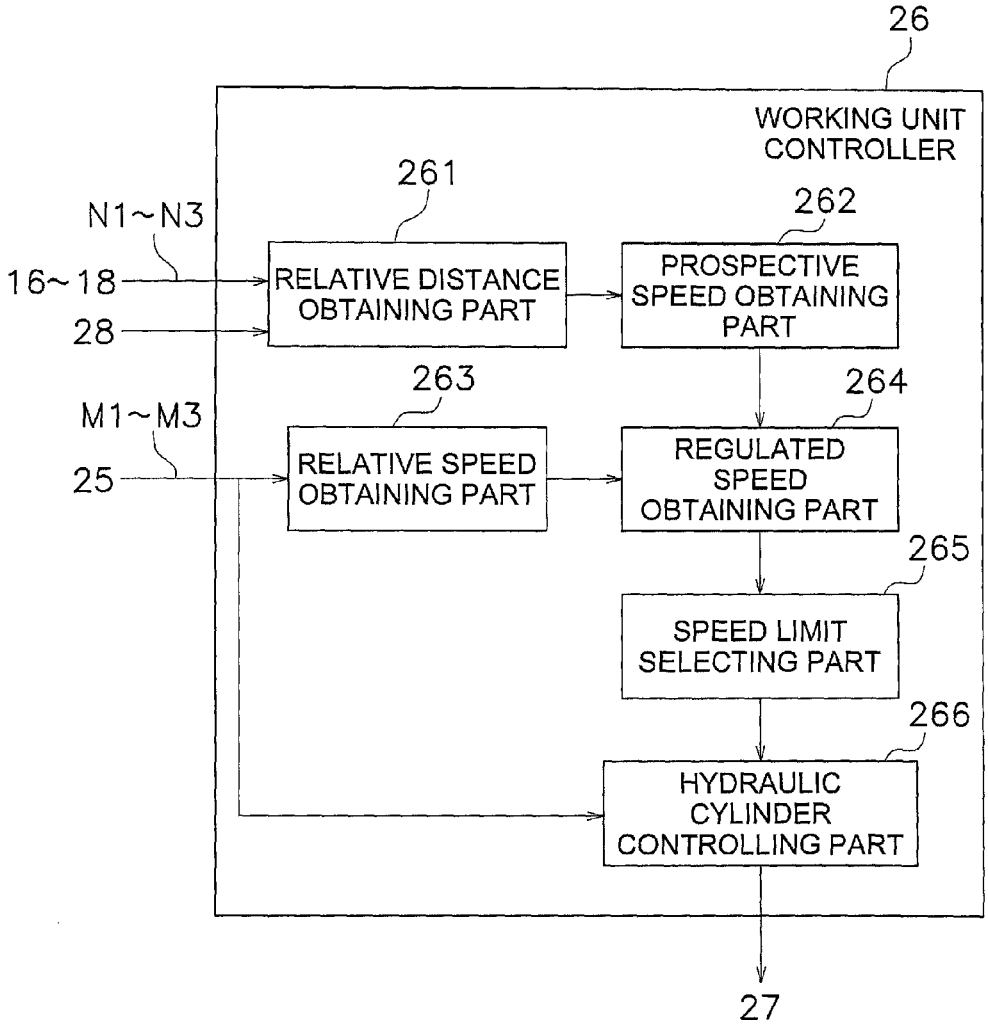
FIG. 6 is a block diagram representing a configuration of a working unit controller 26.
Figure 7:
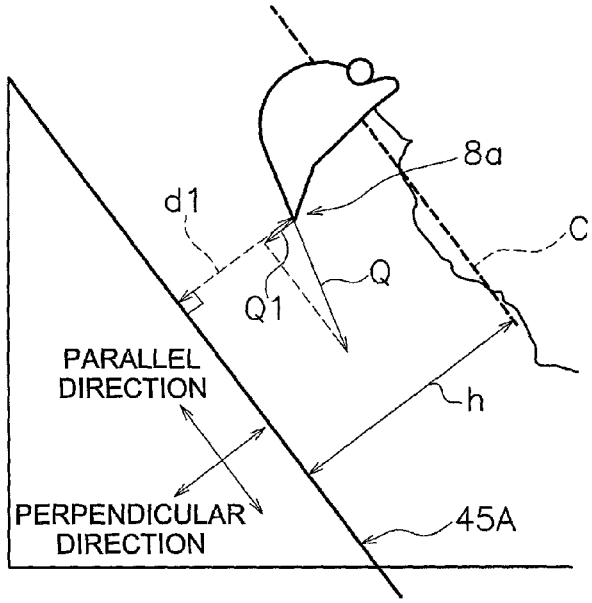
FIG. 7 is a schematic diagram representing a positional relation between a cutting edge 8*a* and a target designed surface 45A.
Figure 8:
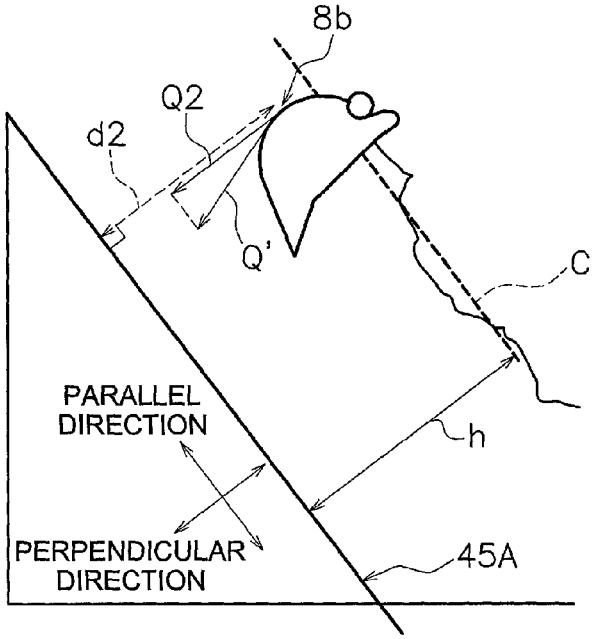
FIG. 8 is a schematic diagram representing a positional relation between a rear surface end 8*b* and the target designed surface 45A.

FIG. 6 is a block diagram representing a configuration of the working unit controller 26. FIG. 7 is a schematic diagram illustrating a positional relation between the cutting edge 8*a* and the target designed surface 45A. FIG. 8 is a schematic diagram illustrating a positional relation between the rear surface end 8*b* and the target designed surface 45A. FIGS. 7 and 8 illustrate a position of the bucket 8 at the same clock time.

As represented in FIG. 6, the working unit controller 26 includes a relative distance obtaining part 261, a prospective speed obtaining part 262, a relative speed obtaining part 263, a regulated speed obtaining part 264, a speed limit selecting part 265 and a hydraulic cylinder controlling part 266.

As illustrated in FIG. 7, the relative distance obtaining part 261 is configured to obtain a first distance d1 between the cutting edge 8*a* and the target designed surface 45A in a perpendicular direction perpendicular to the target designed surface 45A. As illustrated in FIG. 8, the relative distance obtaining part 261 is configured to obtain a second distance d2 between the rear surface end 8*b* and the target designed surface 45A in the perpendicular direction. The relative distance obtaining part 261 is configured to calculate the first distance dl and the second distance d2 based on: the set of designed landform data and the set of present positional data of the hydraulic excavator 100, which are obtained from the display controller 28; and the boom cylinder length N1, the arm cylinder length N2 and the bucket cylinder length N3, which are obtained from the first to third stroke sensors 16 to 18. The relative distance obtaining part 261 is configured to output the first distance d1 and the second distance d2 to the prospective speed obtaining part 262. It should be noted that in the present exemplary embodiment, the first distance d1 is less than the second distance d2.

Figure 9:
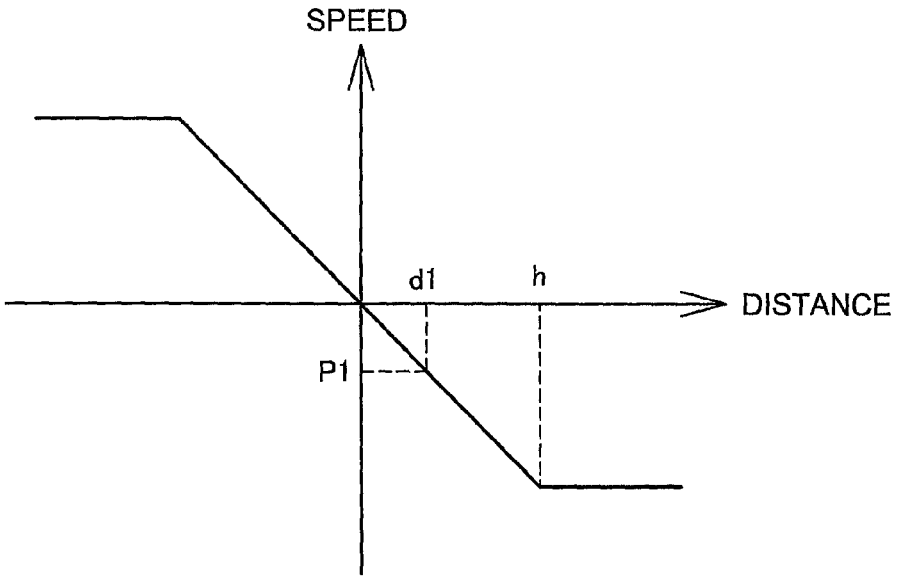
FIG. 9 is a chart representing a relation between a first prospective speed P1 and a first distance d1.
Figure 10:
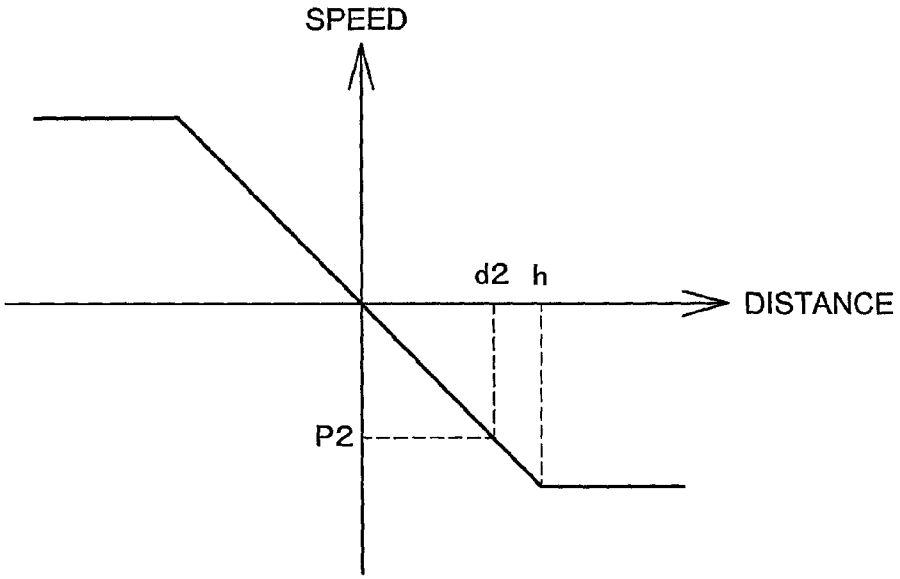
FIG. 10 is a chart representing a relation between a second prospective speed P2 and a second distance d2.

The prospective speed obtaining part 262 is configured to obtain: a first prospective speed P1 set in accordance with the first distance d1; and a second prospective speed P2 set in accordance with the second distance d2. The first prospective speed P1 is herein a speed set in accordance with the first distance d1 in a uniform manner. As represented in FIG. 9, the first prospective speed P1 is maximized where the first distance d1 is greater than or equal to the line distance h, and gets slower as the first distance d1 becomes less than the line distance h. Likewise, the second prospective speed P2 is a speed set in accordance with the second distance d2 in a uniform manner. As represented in FIG. 10, the second prospective speed P2 is maximized where the second distance d2 is greater than or equal to the line distance h, and gets slower as the second distance d2 becomes less than the line distance h. The prospective speed obtaining part 262 is configured to output the first prospective speed P1 and the second prospective speed P2 to the regulated speed obtaining part 264 and the speed limit selecting part 265. It should be noted that a direction closer to the first designed surface 45A is a negative direction in FIG. 9, whereas a direction closer to the second designed surface 452 is a negative direction in FIG. 10. In the present exemplary embodiment, the first prospective speed P1 is slower than the second prospective speed P2.

The relative speed obtaining part 263 is configured to calculate a speed Q of the cutting edge 8*a* and a speed Q' of the rear surface end 8*b* based on the boom operation signal M1, the arm operation signal M2 and the bucket operation signal M3, which are obtained from the operating device 25. Further, as illustrated in FIG. 7, the relative speed obtaining part 263 is configured to obtain a first relative speed Q1 of the cutting edge 8*a* relative to the target designed surface 45A based on the speed Q. As illustrated in FIG. 8, the relative speed obtaining part 263 is configured to obtain a second relative speed Q2 of the rear end surface 8*b* relative to the target designed surface 45A based on the speed Q'. The relative speed obtaining part 263 is configured to output the first relative speed Q1 and the second relative speed Q2 to the regulated speed obtaining part 264.

The regulated speed obtaining part 264 is configured to obtain the first prospective speed P1 from the prospective speed obtaining part 262, while being configured to obtain the first relative speed Q1 from the relative speed obtaining part 263. The regulated speed obtaining part 264 is configured to obtain a first regulated speed S1 for the extension/contraction speed of the boom cylinder 10, which is required to limit the first relative speed Q1 to the first prospective speed P1.

Figure 11:
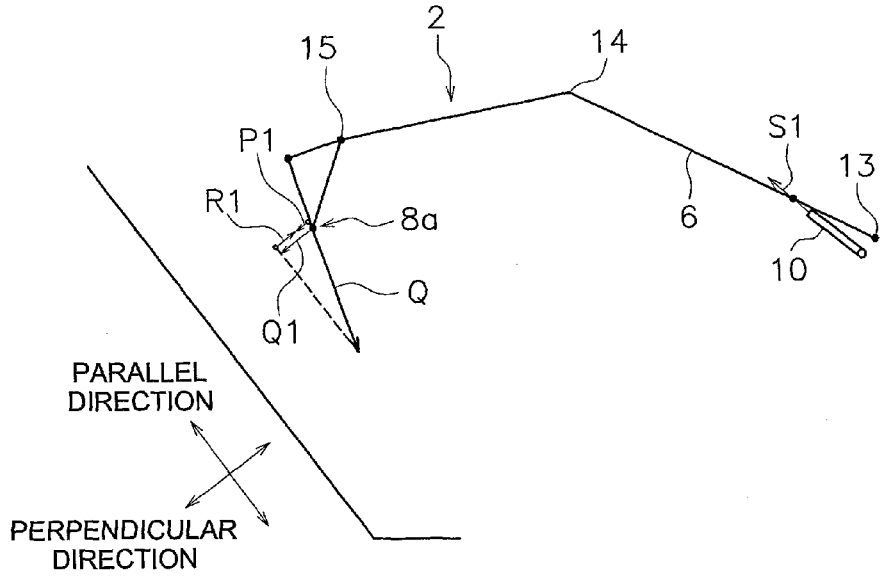
FIG. 11 is a diagram for explaining a method of obtaining a first regulated speed S1.

Now, FIG. 11 is a diagram for explaining a method of obtaining the first regulated speed S1. As illustrated in FIG. 11, the first relative speed Q1 is required to be reduced by the amount of a first differential R1 (=Q1−P1) in order to suppress the first relative speed Q1 to the first prospective speed P1. On the other hand, the speed of the boom 6 is required to be regulated so that the first differential R1 can be eliminated from the first relative speed Q1 only by deceleration in rotational speed of the boom 6 about the boom pin 13. Accordingly, it is possible to obtain the first regulated speed S1 based on the first differential R1.

Further, the regulated speed obtaining part 264 is configured to obtain the second prospective speed P2 from the prospective speed obtaining part 262, while being configured to obtain the second relative speed Q2 from the relative speed obtaining part 263. The regulated speed obtaining part 264 is configured to obtain a second regulated speed S2 for the extension/contraction speed of the boom cylinder 10, which is required to limit the second relative speed Q2 to the second prospective speed P2.

Figure 12:
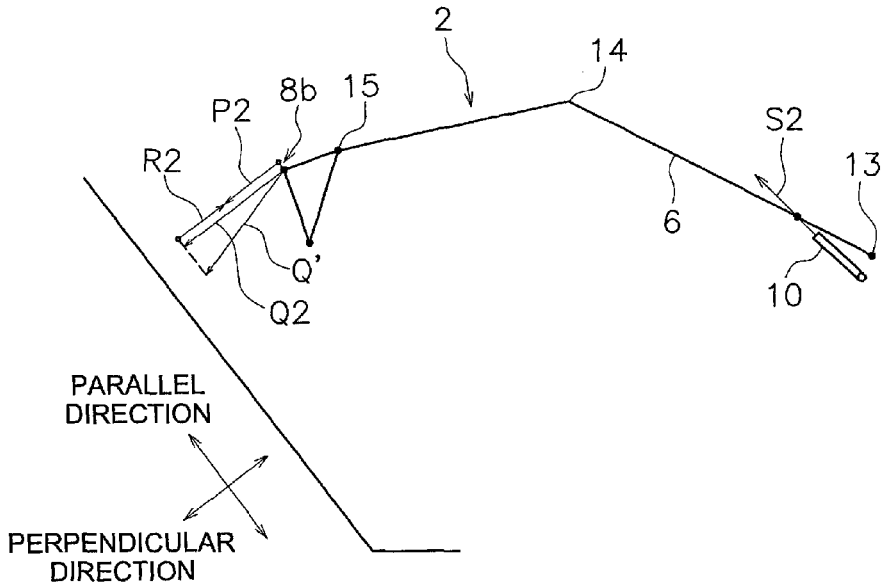
FIG. 12 is a diagram for explaining a method of obtaining a second regulated speed S2.

Now, FIG. 12 is a diagram for explaining a method of obtaining the second regulated speed S2. As illustrated in FIG. 12, the second relative speed Q2 is required to be reduced by the amount of a second differential R2 (=Q2−P2) in order to suppress the second relative speed Q2 to the second prospective speed P2. On the other hand, the speed of the boom 6 is required to be regulated so that the second differential R2 can be eliminated from the second relative speed Q2 only by deceleration in rotational speed of the boom 6 about the boom pin 13. Accordingly, it is possible to obtain the second regulated speed S2 based on the second differential R2.

In the present exemplary embodiment, the second regulated speed S2 is set to be greater than the first regulated speed S1 as illustrated in FIGS. 11 and 12, although the second interval d2 is greater than the first interval d1 as illustrated in FIGS. 7 and 8. This is because, when the speed Q of the cutting edge 8*a* and the speed Q' of the rear surface end 8*b* are different from each other, the first relative speed Q1 of the cutting edge 8*a* and the second relative speed Q2 of the rear surface end 8*b* may be different from each other. Therefore, in the present exemplary embodiment, as described below, speed limitation is configured to be executed based on the rear surface end 8*b* farther away from the target designed surface 45A than the cutting edge 8*a* is.

The speed limit selecting part 265 is configured to obtain the first prospective speed P1 and the second prospective speed P2 from the prospective speed obtaining part 262, while being configured to obtain the first regulated speed S1 and the second regulated speed S2 from the regulated speed obtaining part 264. The speed limit selecting part 265 is configured to select either the first prospective speed P1 or the second prospective speed P2 as a speed limit U based on the first regulated speed S1 and the second regulated speed S2. Specifically, the speed limit selecting part 265 is configured to select the first prospective speed P1 as the speed limit U when the first regulated speed S1 is greater than the second regulated speed S2. By contrast, the speed limit selecting part 265 is configured to select the second prospective speed P2 as the speed limit U when the second regulated speed S2 is greater than the first regulated speed S1. In the present exemplary embodiment, the second regulated speed S2 is greater than the first regulated speed S1. Therefore, the speed limit selecting part 265 selects the second prospective speed P2 as the speed limit U.

The hydraulic cylinder controlling part 266 is configured to limit, to the speed limit U (i.e., the second prospective speed P2), the second relative speed Q2 of the rear surface end 8*b* relevant to the second prospective speed P2 selected as the speed limit U relative to the target designed surface 45A. In the present exemplary embodiment, the hydraulic cylinder controlling part 266 is configured to correct the boom operation signal M1 and is configured to output the corrected boom operation signal M1 to the proportional control valve 27 in order to suppress the second relative speed Q2 to the second prospective speed P2 only by means of deceleration in rotational speed of the boom 6. On the other hand, the working unit controller 26 is configured to output the arm operation signal M2 and the bucket operation signal M3 to the proportional control valve 27 without correcting the signals M2 and M3.

Accordingly, the flow rates of the operating oil to be supplied to the boom cylinder 10, the arm cylinder 11 and the bucket cylinder 12 through the proportional control valve 27 are controlled, and the second relative speed Q2 of the rear surface end 8*b* is limited to the second prospective speed P2.

Action of Excavation Control System 200

Figure 13:
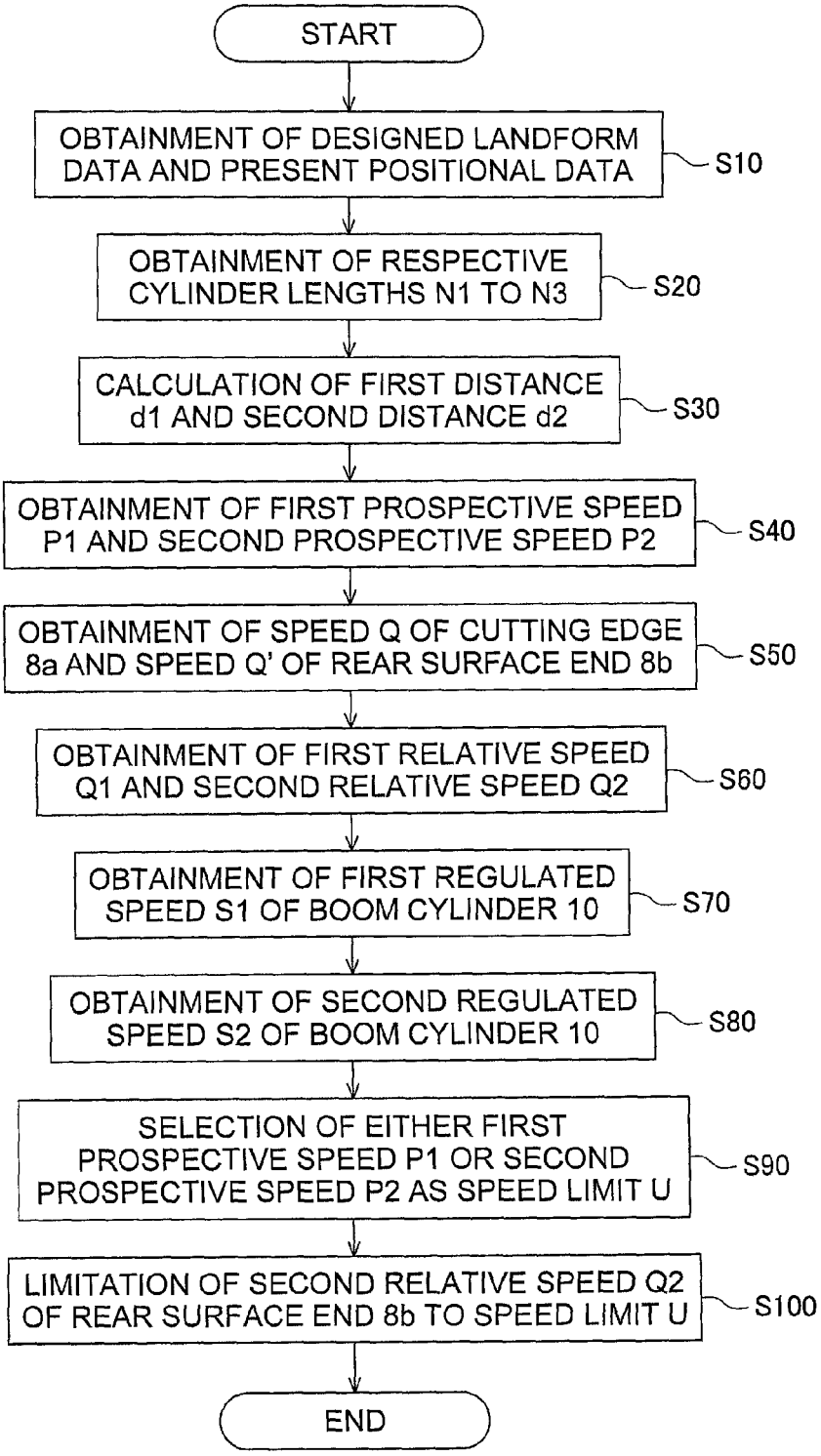
FIG. 13 is a flowchart for explaining an action of the excavation control system 200.

FIG. 13 is a flowchart for explaining an action of the excavation control system 200.

In Step S10, the excavation control system 200 obtains the set of designed landform data and the set of present positional data of the hydraulic excavator 100.

In Step S20, the excavation control system 200 obtains the boom cylinder length N1, the arm cylinder length N2 and the bucket cylinder length N3.

In Step S30, the excavation control system 200 calculates the first distance d1 and the second distance d2 based on the set of designed landform data, the set of present positional data, the boom cylinder length N1, the arm cylinder length N2 and the bucket cylinder length N3 (see FIGS. 7 and 8).

In Step S40, the excavation control system 200 obtains: the first prospective speed P1 depending on the first distance d1; and the second prospective speed P2 depending on the second distance d2 (see FIGS. 9 and 10).

In Step S50, the excavation control system 200 calculates the speed Q of the cutting edge 8*a* and the speed Q' of the rear surface end 8*b* based on the boom operation signal M1, the aim operation signal M2 and the bucket operation signal M3 (see FIGS. 7 and 8).

In Step S60, the excavation control system 200 obtains the first relative speed Q1 and the second relative speed Q2 based on the speed Q and the speed Q' (see FIGS. 7 and 8).

In Step S70, the excavation control system 200 obtains the first regulated speed S1 for the extension/contraction speed of the boom cylinder 10, which is required for limiting the first relative speed Q1 to the first prospective speed P1 (see FIG. 11).

In Step S80, the excavation control system 200 obtains the second regulated speed S2 for the extension/contraction speed of the boom cylinder 10, which is required for limiting the second relative speed Q2 to the second prospective speed P2 (see FIG. 12).

In Step S90, the excavation control system 200 selects either the first prospective speed P1 or the second prospective speed P2 as the speed limit U based on the first regulated speed S1 and the second regulated speed S2. The excavation control system 200 selects, as the speed limit U, the prospective speed P relevant to the greater one of the first regulated speed S1 and the second regulated speed S2. In the present exemplary embodiment, the second regulated speed S2 is greater than the first regulated speed S1. Therefore, the second prospective speed P2 is selected as the speed limit U.

In Step S100, the excavation control system 200 limits, to the speed limit U (i.e., the second prospective speed P2), the second relative speed Q2 of the rear end surface 8*b* relevant to the second prospective speed P2 selected as the speed limit U.

Actions and Effects (1) The excavation control system 200 according to the present exemplary embodiment is configured to obtain: the first regulated speed S1 for the extension/contraction speed of the boom cylinder 10, which is required to limit the first relative speed Q1 to the first prospective speed P1; and the second regulated speed S2 for the extension/contraction speed of the boom cylinder 10, which is required to limit the second relative speed Q2 to the second prospective speed P2. The excavation control system 200 is configured to select, as the speed limit U, the prospective speed P relevant to the grater one of the first regulated speed S1 and the second regulated speed S2.

Thus, speed limitation is executed based on the regulated speed S for the extension/contraction speed of the boom cylinder 10, regardless of the first interval d1 and the second interval d2. Therefore, speed limitation can be executed based on either one of the cutting edge 8*a* and the rear surface end 8*b*, which is relevant to the greater regulated speed S for the extension/contraction speed of the boom cylinder 10.

Here, chances are that regulation for the extension/contraction speed of the boom cylinder 10 is delayed if speed limitation is executed based on the cutting edge 8*a* relevant to the lesser regulated speed S, and thereafter, speed limitation is executed based on the rear surface end 8*b* relevant to the greater regulated speed S when the rear surface end 8*b* approaches the target designed surface 45A. In this case, excavation cannot be executed according to the designed surface when the rear surface end 8*b* goes beyond the designed surface 45A. Further, shocks inevitably occur due to abrupt driving when regulation of the boom cylinder 10 is forcibly attempted. Therefore, an appropriate excavation control cannot be executed.

By contrast, according to the excavation control system 200 of the present exemplary embodiment, speed limitation is executed based on the rear surface end 8*b* relevant to the greater regulated speed S as described above. Therefore, the boom cylinder 10 can afford to be regulated. It is thereby possible to inhibit the rear surface end 8*b* from going beyond the designed surface 45A and inhibit occurrence of shocks due to abrupt driving. Accordingly, an appropriate excavation control can be executed.

(2) The excavation control system 200 according to the present exemplary embodiment is configured to execute speed limitation by regulating the extension/contraction speed of the boom cylinder 10.

Therefore, speed limitation is executed by correcting only the boom operation signal M1 among the operation signals in response to operations by an operator. In other words, among the boom 6, the arm 7 and the bucket 8, only the boom 6 is not driven as operated by an operator. Therefore, it is herein possible to inhibit deterioration of operational feeling of an operator in comparison with the configuration of regulating the extension/contraction speeds of two or more driven members among the boom 6, the arm 7 and the bucket 8.

Other Exemplary Embodiments

An exemplary embodiment of the present invention has been explained above. However, the present invention is not limited to the aforementioned exemplary embodiment, and a variety of changes can be made without departing from the scope of the present invention.

(A) In the aforementioned exemplary embodiment, the excavation control system 200 is configured to set the cutting edge 8*a* and the rear surface end 8*b*, among portions of the bucket 8, as monitoring points. However, the present invention is not limited to this. The excavation control system 200 may be configured to set two or more monitoring points on the outer periphery of the bucket 8.

(B) In the aforementioned exemplary embodiment, the excavation control system 200 is configured to suppress the relative speed to the speed limit only by deceleration of the rotational speed of the boom 6. However, the present invention is not limited to this. The excavation control system 200 may be configured to regulate the rotational speed of at least one of the arm 7 and the bucket 8 in addition to the rotational speed of the boom 6. It is thereby possible to inhibit the speed of the bucket 8 from being reduced in a direction parallel to the designed surface 45 by means of speed limitation. Accordingly, it is possible to inhibit deterioration of operational feeling of an operator. It should be noted that in this case, addition (sum) of the respective regulated speeds of the boom 6, the arm 7 and the bucket 8 may be calculated as the regulated speed S.

(C) In the aforementioned exemplary embodiment, the excavation control system 200 is configured to calculate the speed Q of the cutting edge 8*a* and the speed Q' of the rear surface end 8*b* based on the operation signals M to be obtained from the operating device 25. However, the present invention is not limited to this. The excavation control system 200 can directly calculate the speed Q and the speed Q' based on variation per unit time for each of the cylinder lengths N1 to N3 to be obtained from the first to third stroke sensors 16 to 18. In this case, the speed Q and the speed Q' can be more accurately calculated compared to a configuration of calculating the speed Q and the speed Q' based on the operation signals M.

(D) In the aforementioned exemplary embodiment, as represented in FIGS. 9 and 10, a linear relation is established between the prospective speed and the distance. However, the present invention is not limited to this. An arbitrary relation may be established between the prospective speed and the distance. Such relation is not necessarily a linear relation, and its relational curve is not required to pass through the origin of its relevant chart.

According to the illustrated embodiments, it is possible to provide a working unit control system capable of appropriately executing an excavation control. Therefore, the excavation control system according to the illustrated embodiments is useful for the field of construction machines.

What is claimed is:

1. An excavation control system comprising:

a working unit formed by a plurality of driven members including a bucket, the working unit being rotatably supported by a vehicle main body;

a plurality of hydraulic cylinders configured to drive the plurality of driven, members;

a prospective speed obtaining part configured to obtain a first prospective speed and a second prospective speed, the first prospective speed depending on a first interval between a first monitoring point of the bucket and a designed surface, the second prospective speed depending on a second interval between a second monitoring point of the bucket and the designed surface, the second monitoring point set being differently from the first monitoring point, the designed surface indicating a target shape of an excavation object;

a relative speed obtaining part configured to obtain a first relative speed of the first monitoring point relative to the designed surface and a second relative speed of the second monitoring point relative to the designed surface;

a speed limit selecting part configured to select either of the first prospective speed or the second prospective speed as a speed limit based on a relative relation between the first relative speed and the first prospective speed and a relative relation between the second relative speed and the second prospective speed;

a hydraulic cylinder controlling part configured to limit a relative speed with respect to the designated surface of one of the first and second monitoring points which is a target of the speed limit to the speed limit by supplying an operating oil to the plurality of hydraulic cylinders; and a regulated speed obtaining part configured to obtain a first regulated speed and a second regulated speed, the first regulated speed indicating a target speed for an extension/contraction speed of each of the plurality of hydraulic cylinders which is required to limit the first relative speed to the first prospective speed, the second regulated speed indicating a target speed for an extension/contraction speed of each of the plurality of hydraulic cylinders which is required to limit the second relative speed to the second prospective speed, wherein the speed limit selecting part is configured to select the first prospective speed as the speed limit when the first regulated speed is greater than the second regulated speed, the speed limit selecting part is configured to select the second prospective speed as the speed limit when the second regulated speed is greater than the first regulated speed, and the relative speed obtaining part is configured to obtain the first relative speed and the second relative speed based on a sum of the extension/contraction speeds of respective ones of the plurality of hydraulic cylinders.

2. The excavation control system recited in claim 1, wherein the first prospective speed gets slower as the first interval gets shorter, and the second prospective speed gets slower as the second interval gets shorter.

3. The excavation control system recited in claim 2, wherein the plurality of driven members include a boom rotatably attached to the vehicle main body and an arm coupled to the boom and the bucket, the plurality of hydraulic cylinders include a boom cylinder fix driving the boom and an arm cylinder for driving the arm, and each of the first regulated speed and the second regulated speed corresponds to a target speed for extension/contraction speeds of the boom cylinder and the arm cylinder.

4. The excavation control system recited in claim 1, wherein the plurality of driven members include a boom rotatably attached to the vehicle main body, the plurality of hydraulic cylinders include a boom cylinder for driving the boom, and each of the first regulated speed and the second regulated speed corresponds to a target speed for an extension/contraction speed or the boom cylinder.

5. The excavation control system recited in claim 1, wherein the plurality of driven members include a boom rotatably attached to the vehicle main body and an arm coupled to the boom and the bucket, the plurality of hydraulic cylinders include as boom cylinder for driving the boom and an arm cylinder for driving the arm, and each of the first regulated speed and the second regulated speed corresponds to a target speed for extension/contraction speeds of the boom cylinder and the arm cylinder.

6. The excavation control system recited, in claim 1, further comprising an operating tool configured to receive an user operation to drive the working unit, the operating tool being configured to output an operation signal in accordance with the user operation, where in the relative speed obtaining part is configured to obtain the first relative speed and the second relative speed based on the operation signal.

7. The excavation control system recited in claim 3, further comprising an operating tool configured to receive an user operation to drive the working unit, the operating, tool being configured to output an operation signal in accordance with the user operation, wherein the relative speed obtaining part is configured to obtain the first relative speed and the second relative speed based on the operation signal.

8. The excavation control system recited in claim 1, wherein the first monitoring point is set on a cutting edge of the bucket, and the second monitoring point is set on a bottom plate of the bucket.

9. The excavation control system recited in claim 2, wherein the plurality of driven members include a boom rotatably attached to the vehicle main body, the plurality of hydraulic cylinders include a boom cylinder for driving the boom, and each of the first regulated speed and the second regulated speed corresponds to a target speed for an extension/contraction speed of the boom cylinder.

10. The excavation control system recited in claim 7, wherein the first monitoring point is set. on a cutting edge of the bucket, and the second monitoring point is set on a bottom plate of the bucket.

* * * * *